US008604706B2

(12) United States Patent
Cao et al.

(10) Patent No.: US 8,604,706 B2
(45) Date of Patent: Dec. 10, 2013

(54) LAMP TUBE SWITCH CIRCUIT

(75) Inventors: Qing-Shan Cao, Shenzhen (CN); Zheng-Nian Liu, Shenzhen (CN); Lin-Shu Zhou, Shenzhen (CN); Ye-La An, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 312 days.

(21) Appl. No.: 13/215,208

(22) Filed: Aug. 22, 2011

(65) Prior Publication Data

US 2013/0002150 A1 Jan. 3, 2013

(30) Foreign Application Priority Data

Jun. 28, 2011 (CN) ..... 2011 1 0176613

(51) Int. Cl.
*H05B 37/00* (2006.01)
*H05B 37/02* (2006.01)

(52) U.S. Cl.
USPC ..... 315/178; 315/362; 307/115

(58) Field of Classification Search
USPC ..... 315/178, 312–317, 320, 322, 324, 362, 315/291, 299; 307/38, 112, 113, 115
See application file for complete search history.

(56) References Cited

U.S. PATENT DOCUMENTS

| | | | | |
|---|---|---|---|---|
| 3,828,221 | A * | 8/1974 | Spiteri | 315/161 |
| 4,064,519 | A * | 12/1977 | Kee | 396/190 |
| 4,484,109 | A * | 11/1984 | Buser | 315/290 |
| 8,147,091 | B2 * | 4/2012 | Hsia et al. | 362/221 |
| 8,459,829 | B2 * | 6/2013 | Cao et al. | 362/217.14 |
| 2012/0043909 | A1 * | 2/2012 | Bloom et al. | 315/294 |

FOREIGN PATENT DOCUMENTS

JP 4253182 A 9/1992

* cited by examiner

*Primary Examiner* — Thuy Vinh Tran
(74) *Attorney, Agent, or Firm* — Altis Law Group, Inc.

(57) ABSTRACT

A lamp tube switch circuit supplies power to a selected LED/fluorescent lamp tube connected between first and second connectors and comprises a ballast and a starter. A power supply has positive and negative terminals. A switch module comprises first, second and third switches each having a first end connecting with the positive terminal, fourth and fifth switches each having a first end connecting with the negative terminal and a sixth switch having a first end connecting with the first connector. A button module has six buttons one of which is correspondent to the selected lamp tube. A control unit is connected to the button module, and functions to turn on and turn off the switches with a predetermined mode according the selected lamp tube.

4 Claims, 3 Drawing Sheets

| Button | Type number | Schematic | 131 | 132 | 133 | 134 | 135 | 136 | 137 |
|---|---|---|---|---|---|---|---|---|---|
| 31 | 1 | LED light | 1 | 0 | 0 | 0 | 0 | 1 | 0 |
| 32 | 2 | LED light | 0 | 0 | 1 | 0 | 0 | 1 | 0 |
| 33 | 3 | LED light | 1 | 0 | 0 | 1 | 0 | 0 | 0 |
| 34 | 4 | LED light | 0 | 0 | 1 | 0 | 0 | 1 | 0 |
| 35 | 5 | LED light | 1 | 0 | 0 | 0 | 0 | 1 | 0 |
| 36 | 6 | Fluorescent | 0 | 1 | 0 | 1 | 0 | 0 | 1 |

FIG. 3

LAMP TUBE SWITCH CIRCUIT

CROSS-REFERENCES TO RELATED APPLICATIONS

Related subject matter is disclosed in co-pending U.S. patents application with an Ser. No. 13/215,210 and a title of LAMP TUBE SWITCH CIRCUIT AND METHOD THEREOF, and an Ser. No. 13/215,213 and a title of LAMP TUBE SWITCH CIRCUIT, which have the same assignees as the current application and were concurrently filed.

BACKGROUND

1. Technical Field

The present disclosure relates to switch circuits and, particularly, to a switch circuit for different types of lamp tubes.

2. Description of the Related Art

LEDs are widely used, but cannot be used in conventional lamp holders, for example fluorescent lamp holders, and LED lamp holders cannot be used to hold fluorescent lamps. Therefore, if users want to replace a fluorescent lamp with an LED lamp or replace an LED lamp with a fluorescent, they have to replace the holders as well.

Therefore, there is room for improvement within the art.

BRIEF DESCRIPTION OF THE DRAWINGS

The components in the drawings are not necessarily drawn to scale, the emphasis instead being placed upon clearly illustrating the principles of a lamp tube switch circuit. Moreover, in the drawings, like reference numerals designate corresponding parts throughout the several views.

FIG. 3 is a state diagram of the button module of FIG. 2 when different types of lamp tubes are selected to be connected to the lamp tube switch circuit of FIG. 1.

DETAILED DESCRIPTION

Figure 1:
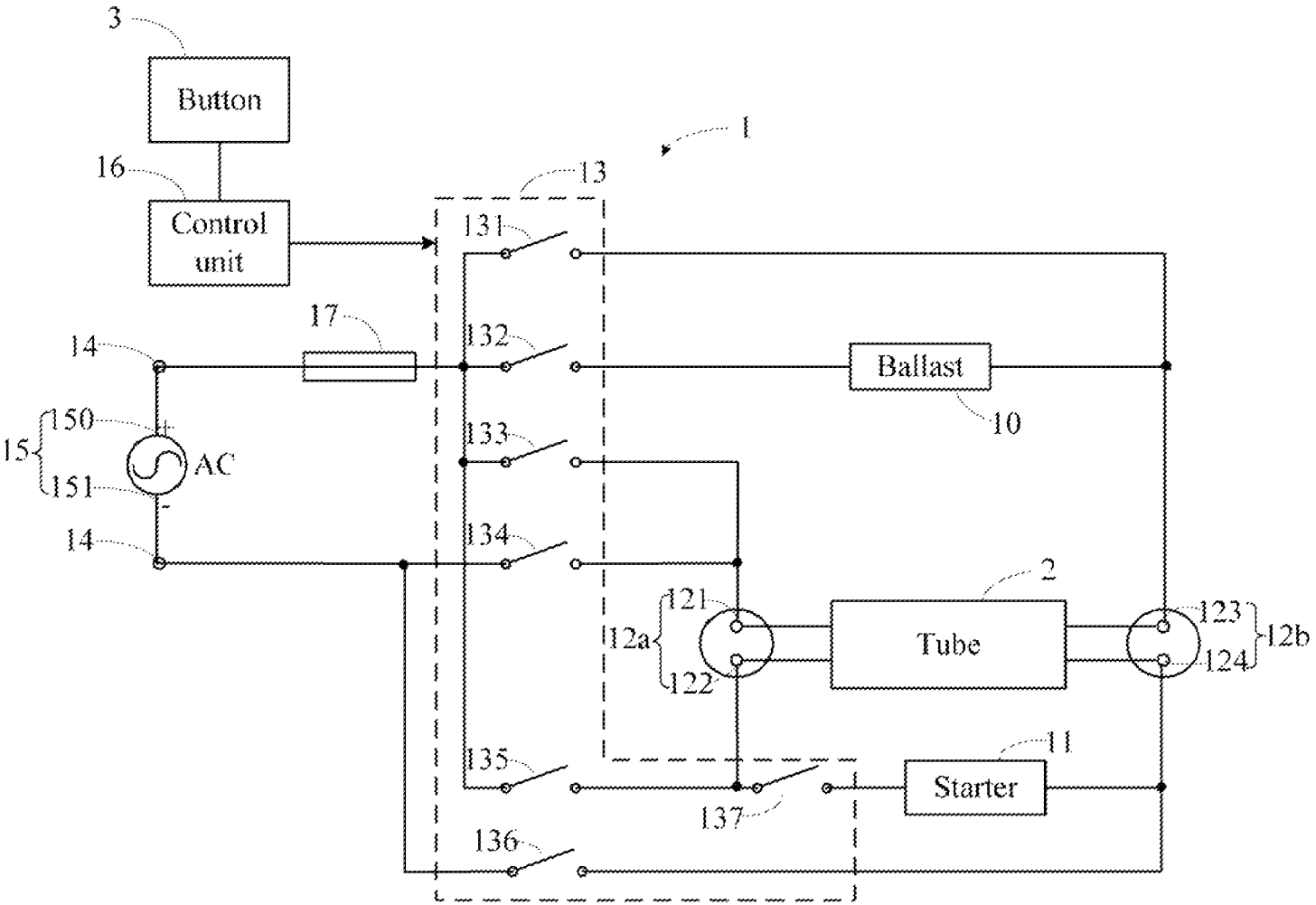
FIG. 1 is a circuit diagram of a lamp tube switch circuit in accordance with an exemplary embodiment.

Referring to FIG. 1, a lamp tube switch circuit 1 includes a ballast 10, a starter 11, a first connector 12*a* and a second connector 12*b* for connecting to a lamp tube 2, and a power port 14 for connecting a power supply 15. The circuit 1 further includes a switch module 13 and a control unit 16. The switch module 13 interconnects the power port 14 with the first connector 12*a* and the second connector 12*b*. The ballast 10 and the starter 11 are connected between the switch module 13 and the second connector 12*b*. The switch module 13 includes at least two switches. The circuit 1 further includes a button module 3 connected to the control unit 16, which includes at least two buttons for selecting a particular type of lamp tube 2. The relationship between each of the at least two buttons and the states of the at least two switches is predetermined. When the control unit 16 determines that one button has been triggered, the control unit 16 turns on one or more of the at least two switches, and turns off the other, or the remaining, switches according to the relationship, to form a drive circuit corresponding to a selected type of lamp tube 2 to drive the selected type of lamp tube 2.

In the embodiment, the switch module 13 includes switches 131, 132, 133, 134, 135, 136, and 137. The switches 131, 132, 133, 134, 135, 136, and 137 are all relays. The control unit 16 switches the relays 131, 132, 133, 134, 135, 136, and 137 on or off. The first connector 12*a* includes a first port 121 and a second port 122, and the second connector 12*b* includes a third port 123 and a fourth port 124.

A first end of each of the switches 131, 132, 133, and 135 is connected to a positive terminal 150 of the power supply 15, and a second end of the switch 132 is connected to a first end of the ballast 10. A first end of the switch 137 is connected to the second port 122 and a second end of the switch 135. A second end of the ballast 10 and a second end of the switch 131 are connected to the third port 123. The first ends of the switches 134 and 136 are connected to a negative terminal 151 of the power supply 15. The second ends of the switches 133 and 134 are connected to the first port 122, and the second end of the switch 136 is connected to the fourth port 124. The starter 11 is connected between the second end of the switch 137 and the fourth port 124.

Figure 2:
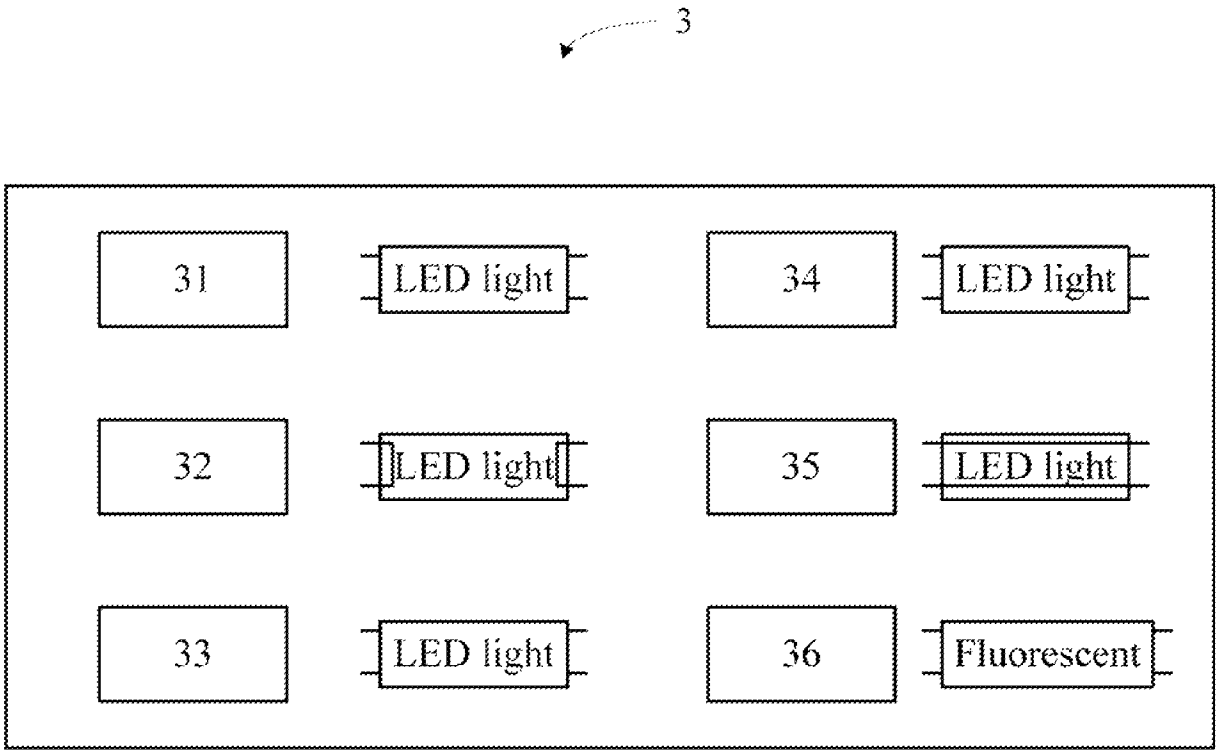
FIG. 2 is a schematic view of a button module of the lamp tube switch of FIG. 1 in accordance with an exemplary embodiment.

Referring to FIG. 2, in the embodiment, the button module 3 includes buttons 31, 32, 33, 34, 35, and 36. Each of the buttons 31, 32, 33, 34, 35, and 36 is used for selecting a type of lamp tube. The button module 3 is arranged on an operational panel 30, and an icon 37 is arranged next to each of the buttons 31, 32, 33, 34, 35, and 36 for indicating which button is used for selecting which type of lamp tube.

FIG. 3 illustrates a state diagram of the bottom module 3 when different types of lamp tubes are selected to be connected to the switch circuit 1. In this diagram, logic "1" is defined to correspond to the "on" state of the at least two switches, and logic "0" is defined to be the "off" state of the at least two switches. The control unit 16 determines which type of lamp tube has been selected by determining which button has been triggered, and turns on or turns off the at least two switches according to the predetermined relationship. In the case of a first type of lamp tube as an example, two conductive pins are mounted on an end of the lamp tube, and two insulation pins are mounted on the other end of the lamp tube. "NC" corresponds to the insulation pins.

When a user triggers the button 31 corresponding to the first type of lamp tube 2, the button 31 generates a trigger signal, and the control unit 16 determines the selected type of lamp tube according to the trigger signal, and turns on one of the at least two switches of the switch module 13, and turns off another or others, according to the predetermined relationship. In the embodiment, the control unit 16 turns on the switches 131 and 136, and turns off the switches 132, 133, 134, 135, and 137. Thus, when the first type of lamp tube 2 is connected to the switch circuit 1, the two conductive pins are respectively connected to the positive terminal 150 and to the negative terminal 151 of the power supply 15 via the third port 123 and the fourth port 124, and the two insulation pins are connected to the first port 121 and the second port 122. Thus, the drive circuit corresponding to the first type of lamp tube 2 is created, and the lamp tube 2 can be powered on.

In the case of the sixth type of lamp tube, taking a fluorescent tube as an illustrative example, two conductive pins are mounted on each end of the fluorescent tube. When a user triggers the button 36 corresponding to a fluorescent tube, the button 36 generates a trigger signal, and the control unit 16 determines the selected type of lamp tube type according to the trigger signal, and turns on and turns off the at least two switches of the switch module 13 according to the predetermined relationship. In the embodiment, the control unit 16 turns on the switches 132, 134 and 137, and turns off the switches 131, 133, 135, and 136. Thus, when the fluorescent tube is connected to the switch circuit 1, the conductive pin connected to the first port 121 is also connected to the negative terminal 151 of the power supply 15, and conductive pin connected to the second port 122 is also connected to the positive terminal 150 of the power supply 15, and the conductive pins connected to the third port 123 and the fourth port 124 are connected between the ballast 11 and the starter 11. Thus, a drive circuit suitable for the fluorescent tube is formed, and the fluorescent tube can be powered on.

The control unit 16 maintains the "on" and the "off" states of the switch module 13 until another button is triggered.

In the embodiment, the switch circuit 1 further includes a fuse 17 connected between the positive terminal 150 of the power supply 15 and the switch module 13, preventing damage to the circuit 1 from a short circuit.

It is understood that the present disclosure may be embodied in other forms without departing from the spirit thereof. Thus, the present examples and embodiments are to be considered in all respects as illustrative and not restrictive, and the disclosure is not to be limited to the details given herein.

What is claimed is:

1. A lamp tube switch circuit for providing power to a lamp tube selected from one of different type of lamp tubes including at least a light emitting diode (LED) lamp tube and a fluorescent lamp tube, the switch circuit comprising:

a first connector comprising first and second ports and a second connector comprising third and fourth ports, wherein the first and second ports are for connecting two pins on an end of the lamp tube and the third and fourth ports are for connecting another two pins on an opposite end of the lamp tube;

a power supply having a positive terminal and a negative terminal;

a switch module comprising first, second and third switches each having a first end connecting with the positive terminal, fourth and fifth switches each having a first end connecting with the negative terminal and a sixth switch having a first end connecting with the second port;

a button module having six buttons one of which is correspondent to the lamp tube connected between the first and second connectors;

a control unit connected to the button module, and functioning to turn on and turn off the switches with a predetermined mode according the lamp tube connected between the first and second connectors after the one of the buttons is activated;

a ballast having a first end connected to a second end of the second switch and a second end connected to a second end of the first switch and the third port; and a starter having a first end connected to a second end of the sixth switch and a second end connected to the fourth port and a second end of the fifth switch, the third and fourth switches having second ends thereof connecting with the first port.

2. The switch circuit as recited in claim 1, wherein when the lamp tube is an LED lamp tube with two conductive pins as the two pins on the end of the lamp tube and two insulation pins as the another two pins on the opposite end of the lamp tube, the two conductive pins are connected to the third and fourth ports and the two insulation pins are connected to the first and second ports, and the first and fifth switches are turned on and the second, third, fourth and sixth switches are turned off.

3. The switch circuit as recited in claim 1, wherein when the lamp tube is a fluorescent lamp tube, the second, fourth and sixth switches are turned on and the first, third and fifth switches are turned off.

4. The switch circuit as recited in claim 1 further comprising a fuse connected between the positive terminal and the first ends of the first, second and third switches.

* * * * *